United States Patent [19]

Rodger

[11] Patent Number: 4,594,885

[45] Date of Patent: Jun. 17, 1986

[54] APPARATUS FOR DRIVING TESTING PROJECTILES

[75] Inventor: Albert A. Rodger, Aberdeen, Scotland

[73] Assignee: National Research Development Corporation, London, England

[21] Appl. No.: 667,444

[22] Filed: Nov. 1, 1984

[30] Foreign Application Priority Data

Nov. 3, 1983 [GB] United Kingdom ..... 8329383

[51] Int. Cl.[4] ..... G01N 33/24

[52] U.S. Cl. ..... 73/84; 73/864.45

[58] Field of Search ..... 73/84, 864.45; 173/21, 173/47, 48, 49; 175/44, 56

[56] References Cited

U.S. PATENT DOCUMENTS

| | | | |
|---|---|---|---|
| 3,004,389 | 10/1961 | Muller | 173/49 |
| 3,215,209 | 11/1965 | Desvaux et al. | 173/49 |
| 3,498,388 | 3/1970 | Jovis | 173/21 |
| 4,061,021 | 12/1977 | Baldwin | 73/84 |
| 4,359,890 | 11/1982 | Coeius | 73/84 |

FOREIGN PATENT DOCUMENTS

| | | |
|---|---|---|
| 938338 | 10/1963 | United Kingdom . |
| 1483901 | 8/1977 | United Kingdom . |
| 2001885 | 2/1979 | United Kingdom . |

*Primary Examiner*—Jerry W. Myracle

*Attorney, Agent, or Firm*—Cushman, Darby & Cushman

[57] ABSTRACT

Method and apparatus for driving projectiles into the ground to acquire useful information about the soil and underlying strata of the earth. The projectile is attached to an oscillating hammer by a resilient spring-mass-spring connection whereby the hammer exerts a cyclically-varying force upon the projectile either with or without direct contact, change between the non-contact and contact modes taking place automatically in response to changes in ground resistance. A remotely-adjustable resilient stop, for instance in the form of a controllable gas spring, may supplement the spring-mass-spring connection and be operable to vary the characteristics of the connection between the hammer and the projectile during use. Also the projectile may be in the form of a hollow coring tube adapted to take core samples and the apparatus may be equipped with instruments which, as core samples are taken, simultaneously give an output indicating the resistance of the ground to penetration by the projectile.

7 Claims, 4 Drawing Figures

17
15
19
18
37
21
20
16
2
39
41
36
38
40
42
10
22
35
4
4
1
5
34
11
3
13
14
31
12
25
30
33
32

APPARATUS FOR DRIVING TESTING PROJECTILES

This invention relates to methods and apparatus for the driving of projectiles, especially to acquire useful information about the ground, that is to say soil and the underlying strata of the earth. While it relates also to the driving of piles and like projectiles which once driven are not recovered, it relates in particular to processes in which the soil and underlying strata are tested for the resistance that they offer to penetration by a projectile, and to processes in which core samples of such soil and strata are taken by propelling a hollow coring tube into them and then withdrawing it complete with the core sample inside.

It is known to drive hollow and vertical coring tubes into the ground by attaching their upper ends to a framework in which two out-of-balance rotors are mounted on a slide with their axes horizontal and parallel. The rotors are driven in contra-rotation, and are located with symmetry one to either side of the vertical axis of the coring tube so that the rotation causes the slide to oscillate and so exert an alternating force upon the tube in a vertical direction only. The tube and the frame are connected by a spring linkage which, in its relaxed state, can hold them apart so that there is a positive gap between an anvil mounted on the top of the tube and a hammer mounted on a confronting face of the slide. Alternatively the springs may be compressed to provide a zero gap or even a negative gap where the equilibrium position of the hammer lies below the anvil. In use, the frame and tube are guided to move vertically as penetration proceeds. Such apparatus has the useful characteristic that it can operate in two modes when a positive gap exists between the hammer and the anvil: a vibratory mode, in which the oscillating vertical force generated by the rotors is transmitted to the tube by the spring linkage alone, and a vibro-impact mode—that is to say a mode in which both vibrations and impacts occur—when the amplitude of the vertical oscillation of the frame is such that the hammer hits the anvil. The frequency of the impacts is determined by both the machine and ground characteristics and may be less than the frequency of rotation of the rotors. With the rotor frequency held constant, as the tube descends through the ground the mode of propulsion of the tube adjusts automatically to match changes in the character of whatever stratum at any moment confronts the tip of the tube. The mode will be vibratory—that is to say, the gap between the hammer and the anvil will never close—whenever the tip is passing through loose non-cohesive strata, and will only turn into the vibro-impact mode when the tip encounters a more compacted or cohesive stratum. When that happens, the resistance to the downward movement of the tube is so great that a high proportion of the energy transferred to the tube by the rotors on each downward-moving part of their cycle is translated not into moving the tube downwards through the ground but into compressing the spring linkage between the frame of the tube, so that the hammer now makes impact with the anvil at a frequency determined by machine and ground characteristics. Such impact is necessary to make further progress through a stratum of such resistance, but is undesirable for the less cohesive strata previously encountered, which as they are received into the tube are less disturbed by purely vibratory propulsion than they would be by the vibration of the tube that direct impact inevitably causes. The point at which transition occurs from the self-adjusting vibratory mode to the vibro-impact mode may be controlled by the initial gap setting—the more positive the initial gap the later the occurrence of the transition point.

Another known type of apparatus, as described for instance in UK Pat. No. 1483901, also makes use of a vibrating slide which carries a hammer and a coring tube which carries an anvil. In this apparatus, however, the tube and vibrator are not connected by a spring which is compressed as the two members converge. Instead, a frame is attached to the top of the tube: the vibrator slides axially within this frame, and when the vibrator is at one end of its travel, the hammer is in contact with the anvil. A fluid-operated spring is mounted on the other end of the frame to bear against the vibrator so as to urge the hammer and anvil into contact. The fluid spring may for instance comprise a cylinder connected to a source of fluid at variable pressure, and a plunger may slide closely within a passage formed through the wall of the chamber, the inner end of the plunger being acted on by the fluid inside the chamber and the outer end bearing against the vibrator. The working of this second type of apparatus is such that it cannot create a positive gap and hence cannot provide self adjustment in the vibratory mode previously described. When this apparatus operates in its vibratory mode the hammer and the anvil are in constant contact instead of being totally separated. If the rotor speeds and chamber pressure stay constant, the changeover from the vibratory to a purely impact mode of operation occurs when the ground resistance to the penetration of the core tube becomes so high that the vibrator compresses the fluid spring enough to allow the hammer to leave contact with the anvil as the vibrator travels the upward leg of its reciprocating movement. This type of apparatus cannot provide a truly vibro-impact motion (as already defined) due to the energy-absorbing capacity of the fluid spring.

The second type of known apparatus just described has the advantage that during use its performance can be adjusted, to respond to unexpected changes in ground condition for instance, in two ways: by varying either the speed of the rotors, or the pressure within the fluid spring by an operator. Its disadvantage is the lack of a truly self-adjusting "vibratory" mode of operation, that is to say a mode in which only a spring connects the tube to its driving mechanism. When this form of apparatus is not in its impact mode, the hammer and the anvil are nominally in constant contact but will inevitably be subject to relative movements which will distort the desired vibration. The apparatus first described has the advantage of a truly "vibratory" mode of operation for the penetration of non-cohesive ground, but the disadvantage of only one means of adjustment—alteration of rotor speed—to meet unexpected changes in ground character during use outside its range of self-adjustment. It is an object of the present invention, in one of its aspects, to provide apparatus for the driving of projectiles that achieves an improved balance between the advantages and disadvantages so far described. According to this aspect of the invention the apparatus comprises an anvil for attachment to a projectile, and a hammer mounted to oscillate under resilient restraint including a resilient spring-mass-spring connection between the vibrator and the anvil whereby cyclically variable force may be transmitted from the former to the latter with or without direct contact between hammer and the anvil. The resilient connection is capable of distorting so that the oscillation of the vibrator leads to cyclical impact between the hammer and the anvil, and the resilient restraint also includes a remotely adjustable unit, by adjustment of which the motion of the vibrator and hence of the drive imparted to the projectile may be varied during use. By a resilient spring-mass-spring connection between the vibrator and the projectile we mean a connection such that increasing relative displacement between vibrator and projectile in either direction along their common axis of movement results in an increasing force of restoration exerted by the connection. The springs may most conveniently be of solid mechanical type, for instance coil springs. The remotely-adjustable unit may be in the form of a piston or plunger driven by a cylinder connected to fluid at variable pressure.

According to a second and related aspect, apparatus according to the invention comprises a projectile presenting an anvil, and a hammer adapted both for connection to a vibrator unit and to oscillate relative to the projectile under resilient restraint including a resilient connection between hammer and projectile, whereby the hammer unit when driven in vibration may drive the projectile in either an impact mode in which contact occurs cyclically between the hammer and the anvil or in a vibratory mode in which no such contact takes place, in which the projectile is hollow and in the form of a coring tube adapted to take core samples, and in which the apparatus is fitted with instruments whereby, as the projectile penetrates ground to take core samples, signals are also produced to give an output indicative of the resistance of the ground to penetration by the projectile.

Preferably the instrumentation is calibrated so that this output is compatible with the result (the Standard Penetration Number) that would be obtained on a standard penetration test of the ground concerned.

The instrumentation may include a load cell adapted to generate signals indicating the force with which the ground resists entry by the projectile tip, means to generate signals indicative of the speed and depth of penetration, and means to generate signals indicative of the velocity of the hammer relative to the coring tube. The load cell may be annular in form, located between the shaft of the coring tube and a separate tip member. The means to indicate speed and depth of penetration may be in the form of an acoustic emitter/reflector combination, one of these members being adapted to be fixed to the ground and the other being fixed relative to the projectile. The means to generate signals indicative of the velocity of the hammer relative to the coring tube may be in the form of a velocity transducer.

There may also be means to derive outputs indicative of soil texture from the output of the velocity transducer and from this same transducer to produce outputs in which total resistance to the further movement of the tube within the ground is correlated with the depth of penetration.

Such apparatus according to the invention may be separate from the vibrator itself, and may thus effectively consist of a combined corer/penetrometer adapter for attachment to a chosen vibrator drive. Alternatively the apparatus may include the vibrator and thus constitute a self-contained, self-driving corer/-penetrometer.

The invention will now be described, by way of example, with reference to the accompanying drawings in which.

Figure 1:
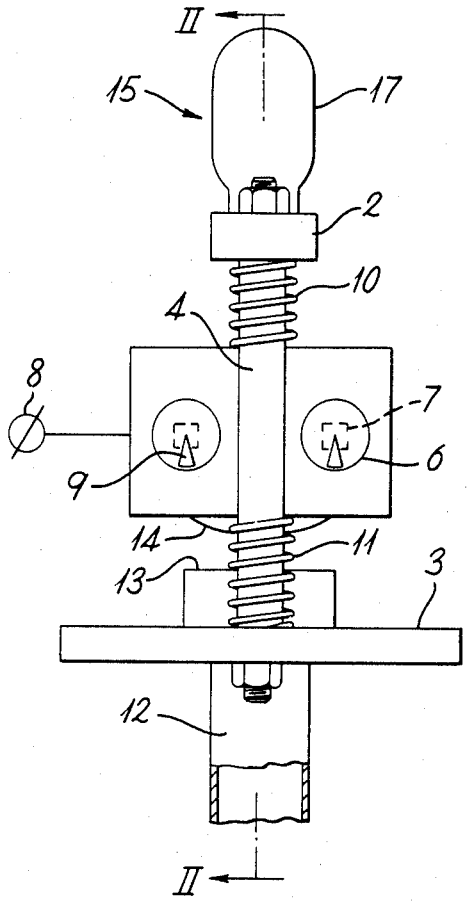
FIG. 1 shows an apparatus including a vibrator, in elevation.

A framework 1 comprises a top plate 2 and a bottom plate 3 jointed by two vertical columns 4. The columns serve also as the guides for the vertical reciprocation of a vibrator unit 5 including two out-of-balance rotors 6 driven by hydraulic motors which are shown diagrammatically at 7 and are driven from a remote pressurised fluid supply 8. Rotors 6 are driven at the same speed, in contrarotation and with their eccentric masses 9 symmetrically disposed so that the rotation transmits only a vertical oscillating force, and no resultant horizontal force, to the framework 1. Upper springs 10 and lower springs 11 separate the vibrator unit 5 from the top plate 2 and bottom plate 3 respectively, the bottom plate is attached both to a coring tube 12 and to an anvil 13, and unit 5 carries a hammer 14. A fluid spring 15 is fixed to top plate 2 at 16 and comprises a hollow vessel 17 the interior of which is connected to a second fluid power source 18 by way of a control restrictor 19. A plunger 20 makes a fluid-sealed but sliding fit within an orifice 21 formed in the wall of vessel 17, and the tip 22 of the plunger bears against the top face of vibrator unit 5.

As already explained in relation to known apparatus, the location of unit 5 within the framework 1 by springs 10 and 11 makes it possible by appropriate choice of those springs not only set an initial vertical gap between anvil 13 and hammer 14 but also to determine the exact dimension of that gap. This choice of gap, together with some ability to determine the speed of rotation of rotors 6 by appropriate choice of power source 8, gives such apparatus great versatility. In particular the apparatus is capable of working both in a truly self-adjusting "vibratory" mode in which there is no contact between anvil 13 and hammer 14 and all downward forces are transmitted from unit 5 to tube 12 by way of springs 11 only, or working in a combined vibration and impact mode in which conditions have caused the amplitude of movement of unit 5 to rise and/or springs 11 to compress to such an extent that hammer 14 strikes anvil 13 at a frequency determined by the machine and ground characteristics, and of responding automatically to changing ground conditions so that the apparatus tends to work in the vibratory mode when tube 12 is penetrating non-cohesive ground but to change to the vibro-impact mode when ground character changes so that the vibratory mode is no longer capable of penetrating it efficiently. The characteristics of springs 10, 11 and of rotors 6 and their fluid supply will of course be chosen to match the predicted characteristics of the particular piece of ground upon which the apparatus is to be used. It can however sometimes occur that such predictions are incorrect, and that ground conditions change in such a way that the change-over of the apparatus from its vibratory to its impact modes does not occur as it should, or occurs at inappropriate times. For instance if the springs 10, 11 and the characteristics of both rotors have been chosen so that the apparatus is to work predominantly in its vibratory mode—which is appropriate—as it penetrates a deep stratum of dense sand, the change of resistance resulting from a sudden transition into an unexpected underlying stratum of stiff clay may cause the apparatus to change into its impact mode but may not be able to generate impact force of the magnitude which such clay would certainly require. The inclusion, according to the invention, of the extra variable in the form of the fluid spring 15 gives the operator a simple means, by use of restrictor 19, of altering the spring characteristics of the apparatus in such circumstances, thus effectively decreasing the spring load on the top of unit 5 and so increasing the gap between anvil 13 and hammer 14 so that higher impact forces may be generated. The fluid spring 15 thus widens the range of soil conditions over which self-adjustment is possible.

Figure 3:
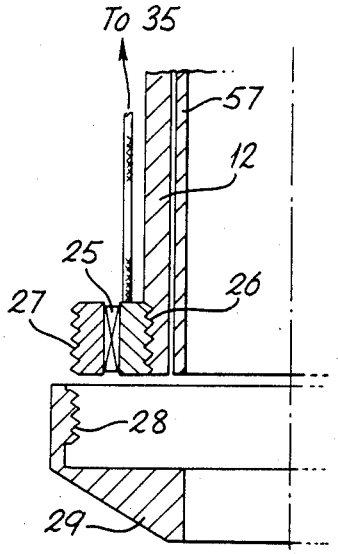
FIG. 3 is a section through the tip of the coring tube, showing the load cell.
Figure 2:
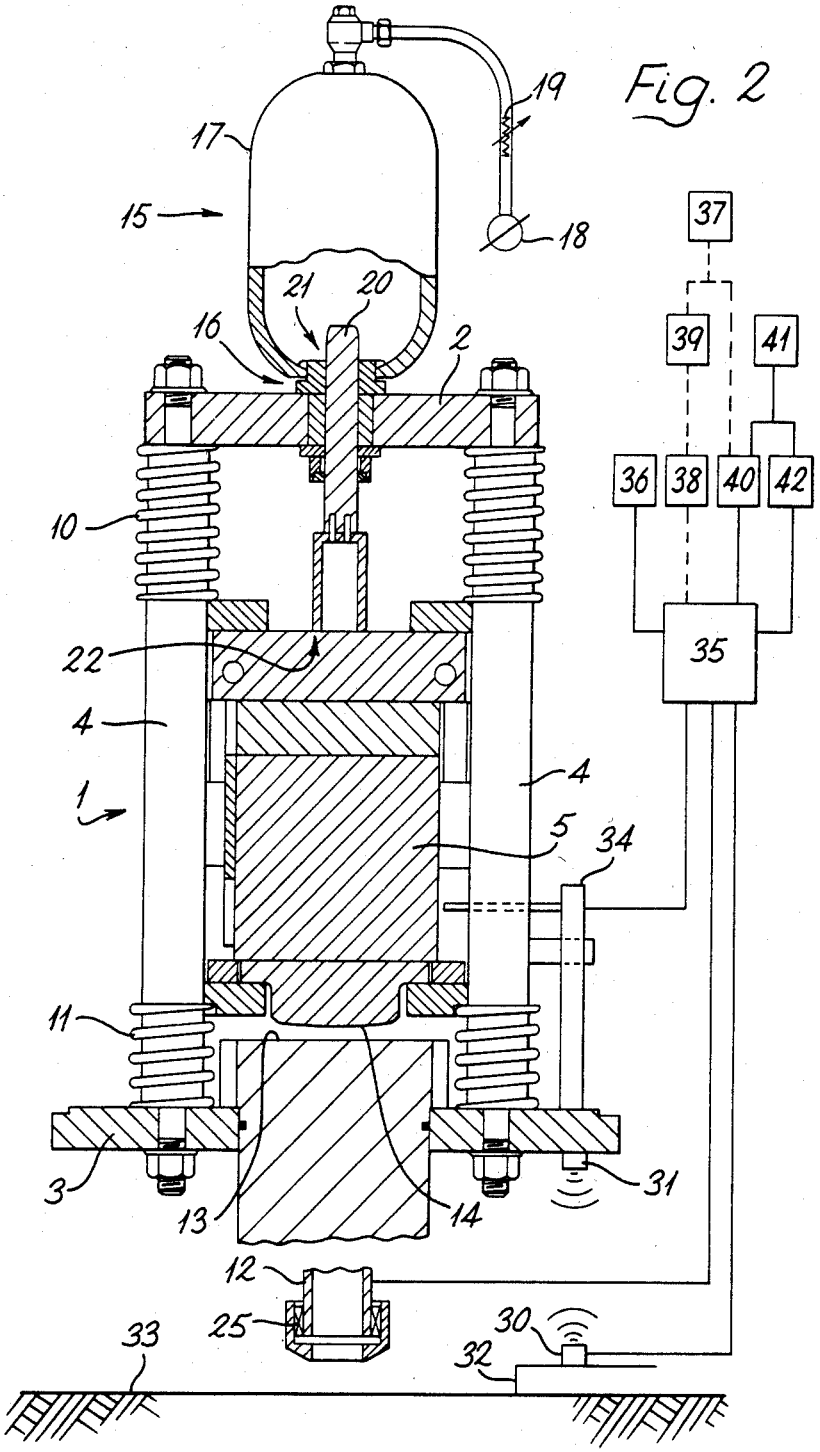
FIG. 2 is a section on the line II—II in FIG. 1, and includes a schematic representation of associated instrumentation and circuits.

Hitherto, the taking of core samples from the ground and the testing of ground for its resistance to penetration have customarily been performed by different types of apparatus, operated in quite different ways. As has been explained, coring tubes have been propelled into the ground by vibrating hammers. The standard penetrometer, however, has been a different type of apparatus by which a solid projectile of standard dimensions has been propelled into the ground by successive hammer blows, each blow delivering a standard quantum of energy to the projectile. A generally accepted measure of ground resistance, known as the Standard Penetration Number, is essentially a measure of the number of such standard blows required to cause the standard projectile to travel a predetermined distance through the ground. In another of its aspects, the present invention provides an apparatus that can act as a penetrometer—that is to say, give useful readings of ground resistance—at the same time as it is taking core samples. This is possible as the apparatus self-adjusts according to the soil resistance encountered. Instrumentation to give this facility, and some others also, is shown in FIGS. 2 and 3 and comprises firstly a load cell 25 mounted at the forward tip of coring tube 12. As FIG. 3 shows best, this cell may conveniently be in the form of an annular unit, internally threaded at 26 to engage with the threaded end of the body of tube 12 and externally threaded at 27 to engage with internal threads 28 formed on a separate, short annular tip unit 29. FIG. 3 also shows an inner liner 57 to tube 12. The instrumentation further comprises the combination of an acoustic emitter 30 with a reflector 31, the emitter being mounted in use upon structure 32 fixed to the ground 33 and the reflector 31 being mounted on bottom plate 3 and thus fixed relative to tube 12 and anvil 13. There is also a velocity transducer 34, fixed to framework 1 and co-operating with vibrator unit 5 so as to produce an output indicative of the instantaneous velocity of unit 5 relative to framework 1.

The outputs of units 25, 30, 31, and 34 all pass to a signal conditioning unit indicated schematically at 35 in FIG. 2. Three potential and useful outputs of unit 35 are indicated. Firstly an output 36 indicative generally of soil texture, which may be derived principally from the output of transducer 34. The transducer monitors the relative velocity between the hammer and the anvil and therefore the self-adjustment of the apparatus as it encounters soils of different resistance and textural character. Examination of the form of the response 'signatures' so monitored provides a means of identification of the textural class of the soil.

The second output 37 is a reading compatible with the standard penetration number N for the ground through which the tip 29 of tube 12 is passing and is derived from two sub-outputs of unit 35. Firstly a signal 38 derived from transducer 34 which is indicative of the velocity of the hammer 14 at each successive impact that it makes with anvil 13: signals 38 are summed to give a signal 39 indicative of the energy transferred from the hammer to the anvil over a predetermined time interval. A second suboutput signal 40 of unit 35 is derived principally from the emitter/reflector combination 30, 31, and indicates the depth of penetration achieved by the coring tube over the same time interval as applies to signal 39. Signals 39 and 40 are combined by relating them with a predetermined distance of penetration—for instance, 300 mm so as to be consistent with standard penetration tests—leading to output 37 as already described.

A third output 42 of unit 35 is indicative of the resistance that the ground offers at any moment at the tip 29 of the coring tube 12. Signals 40 and 42 are combined to give a signal 41 indicative of the tip resistance at any depth.

This of course differs from signal 37 because the former indicates only the vertical force of reaction of the tip against the ground, whereas the latter indicates the total resistance to penetration which includes also the frictional drag upon the walls of tube 12 of those strata through which the tip has already passed.

Figure 4:
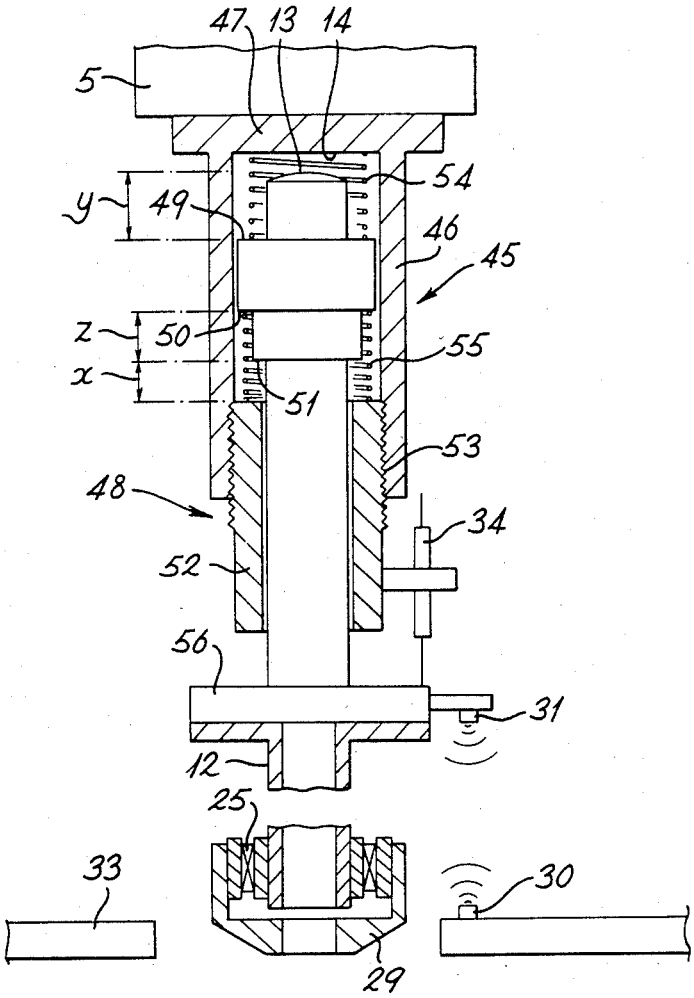
FIG. 4 is a section through an adapter unit according to the invention.

The version of the invention shown in FIGS. 1 and 2 is essentially a complete, self-contained and self-driving apparatus capable of working both as a corer and as a penetrometer. The alternative apparatus shown in FIG. 4 is in the form of an undriven unit capable, when attached to a suitable vibrator, of operating both as a vibro-impact corer and as a penetrometer. It may thus find special use as an adaptor unit which can be attached to the vibrator of a standard vibro-corer, in place of the existing coring tube, to extend the range of use to which that apparatus can be put. The uppermost component of the illustrated adaptor is a unit 45 comprising a hollow cylindrical tube 46 open at its lower end but closed at its upper end by a plate 47. The upper surface of this plate is adapted to be attached to a vibrator unit such as item 5 of FIGS. 1 and 2, and the lower surface of plate 47 acts as the hammer 14. A solid and circular-section unit 48, attached to coring tube 12, is mounted to slide within tube 46. The uppermost surface of this unit acts as the anvil 13 and steps 49, 50 and 51 are formed in the outer wall of the unit. Below step 51, unit 48 makes a sliding fit within an annular-section cylindrical member 52, the top end of which makes threaded engagement with tube 46 at 53. A spring 54 between the hammer 14 and step 49 has the same function as spring 11 of previous figures, and another spring 55 separating step 50 from the upper surface of unit 52 is equivalent to spring 10. Plate 56, which is attached to the bottom end of unit 48 and to which the tube 12 is in turn attached, is equivalent to bottom plate 3 and carries both the velocity transducer 34 and the acoustic reflector 31. The acoustic emitter 30 is fixed to the ground 33 as before, and the arrangement of the load cell 25 and associated components at the tip of tube 12 may also be as before.

In use, when the upper surface of plate 47 is attached to vibrator unit 5, spring 54 will be compressed simply due to the weight of unit 5. The degree of compression of the lower spring 55 may be adjusted by rotating unit 52 relative to tube 46 and so changing the length of threaded engagement 53. Compressing spring 55 in this way will have the additional effect of forcing unit 5 downwards, further compressing spring 54, until eventually the point is reached where there is zero gap between the hammer and the anvil and the apparatus is therefore set to perform as a vibro-impactor at zero gap. In designing this apparatus dimension y of unit 48 has to be chosen as to be compatible with the strength of spring 54, dimension x between step 51 and the top of unit 52 must be greater than the amplitude of the vibration of unit 5, and the dimension z must be compatible with the strength of spring 55. It will be appreciated as a practical matter that the initial compression of spring 54 should be greater than the amplitude of vibration, and that the sum of the initial compression of spring 55 and the amplitude of vibration should be less than the maximum deflection of spring 55.

It should be appreciated that although the variable spring load of the first aspect of this invention, exemplified by the fluid spring 15 of FIG. 1, has the practical advantages already described, it is not essential to the second aspect of the invention as just described with particular reference to FIGS. 2 and 3. And whereas it is customary and often convenient to drive rotors 6 by means such as the hydraulic rotors 7, other forms of drive, for instance electric motors preferably with motor controls so that their speed can be varied if desired during use, are also possible.

I claim:

1. Projectile-propelling apparatus comprising:

a projectile in the form of a coring tube adapted to take core samples from the ground;

an anvil presented by said projectile;

a hammer adapted both for connection to a vibrator unit and to oscillate relative to said projectile under resilient restraint;

said resilient restraint including a resilient spring-mass-spring connection between said hammer and said projectile whereby said hammer when driven by such a said vibrator unit may drive said projectile either in an impact mode in which contact occurs cyclically between said hammer and said anvil or in a vibratory mode in which no such contact takes place;

a signal producing instrument adapted, as said projectile penetrates ground to take said core samples, to produce an output indicative of the resistance of said ground to penetration by said projectile.

2. Apparatus according to claim 1 in which said signal-producing instruments are calibrated so that their said output is compatible with the result that would be obtained on a standard penetration test of said ground.

3. Apparatus according to claim 1 in which said signal-producing instruments include a load cell adapted to generate signals indicative of the force with which said ground resists entry by said proejctile, means to generate signals indicative of the speed and depth of penetration, and means to generate signals indicative of the velocity of said hammer relative to said projectile.

4. Apparatus according to claim 1 in which said means to generate signals indicative of said velocity of said hammer relative to said projectile is in the form of a velocity transducer.

5. Apparatus according to claim 1 in which said load cell is annular in form, in which said coring tube comprises a main shaft and a separate tip, and in which said annular load cell is located between said shaft and said tip.

6. Apparatus according to claim 1 including means to derive signal outputs indicative of the said texture of said ground from information relating to the velocity of said hammer relative to said projectile, and thereby to produce signal outputs in which the total resistance to the further movement of said projectile within said ground is correlated with the depth of said penetration.

7. A method of taking core samples of the ground and simultaneously obtaining outputs indicative of the resistance offered by said ground to penetration by a projectile, using apparatus according to claim 1.

* * * * *